US011523663B2

(12) United States Patent
Lim

(10) Patent No.: US 11,523,663 B2
(45) Date of Patent: Dec. 13, 2022

(54) ACCESSORIES FOR WHICH SMALL GEMSTONES CAN BE UTILIZED AND METHOD FOR MANUFACTURING SAME

(71) Applicant: Hyo Min Lim, Seoul (KR)

(72) Inventor: Hyo Min Lim, Seoul (KR)

(73) Assignee: JIT & CO CO., LTD, Seoul (KR)

( * ) Notice: Subject to any disclaimer, the term of this patent is extended or adjusted under 35 U.S.C. 154(b) by 83 days.

(21) Appl. No.: 17/265,323

(22) PCT Filed: Sep. 6, 2019

(86) PCT No.: PCT/KR2019/011525
§ 371 (c)(1),
(2) Date: Feb. 2, 2021

(87) PCT Pub. No.: WO2020/055042
PCT Pub. Date: Mar. 19, 2020

(65) Prior Publication Data

US 2021/0227940 A1 Jul. 29, 2021

(30) Foreign Application Priority Data

Sep. 14, 2018 (KR) ..... 10-2018-0109914

(51) Int. Cl.

| | |
|---|---|
| ***A44C 27/00*** | (2006.01) |
| ***A44C 17/02*** | (2006.01) |
| ***A44C 5/00*** | (2006.01) |
| ***A44C 7/00*** | (2006.01) |
| ***A44C 9/00*** | (2006.01) |

(52) U.S. Cl.
CPC ..... *A44C 17/02* (2013.01); *A44C 5/0084* (2013.01); *A44C 7/00* (2013.01); *A44C 9/00* (2013.01)

(58) Field of Classification Search
CPC ..... A44C 17/02; A44C 5/0084; A44C 7/00; A44C 9/00; A44C 17/0241; A44C 17/025; A44C 17/04; A44C 5/00; A44C 5/0092
USPC ..... 29/8, 896.4, 896.41, 896.411, 896.412
See application file for complete search history.

(56) References Cited

U.S. PATENT DOCUMENTS

| | | | | |
|---|---|---|---|---|
| 921,759 | A * | 5/1909 | Walker | A44C 9/00 63/3 |
| 5,528,909 | A | 6/1996 | Tonokawa | |
| 6,412,304 | B1 * | 7/2002 | Adelman | A44C 17/04 63/26 |
| 7,412,757 | B2 * | 8/2008 | Corkran | B23K 1/20 63/15 |

(Continued)

FOREIGN PATENT DOCUMENTS

| | | |
|---|---|---|
| EP | 0200924 A2 | 11/1986 |
| JP | 07-031695 Y2 | 7/1995 |

(Continued)

*Primary Examiner* — Jack W Lavinder
(74) *Attorney, Agent, or Firm* — Novick, Kim & Lee, PLLC; Jae Youn Kim

(57) ABSTRACT

The present invention relates to accessories for which small gemstones can be utilized and a method for manufacturing same. The technical gist of the present invention is to firmly fix small gemstones, which are difficult to use due to the small size thereof, to accessories (rings, bracelets, or earrings) by a simple method, and minimize the deformation of earrings due to heat by welding a wire to the earrings with laser, thereby reducing manufacturing cost and increasing completeness of products (accessories).

1 Claim, 3 Drawing Sheets

(56) References Cited

U.S. PATENT DOCUMENTS

| | | | | |
|---|---|---|---|---|
| 7,520,058 | B1 * | 4/2009 | Allen | A44C 27/00 63/15 |
| D941,176 | S * | 1/2022 | Zhao | D11/42 |
| 2017/0265608 | A1 * | 9/2017 | Rotstein | A44C 17/0241 |

FOREIGN PATENT DOCUMENTS

| | | | |
|---|---|---|---|
| JP | 2878167 | B2 | 4/1999 |
| JP | 4540678 | B2 | 9/2010 |
| KR | 20-0289734 | Y1 | 9/2002 |
| KR | 10-1966051 | B1 | 4/2019 |

* cited by examiner

ACCESSORIES FOR WHICH SMALL GEMSTONES CAN BE UTILIZED AND METHOD FOR MANUFACTURING SAME

TECHNICAL FIELD

The present invention relates to accessories for which small gemstones can be utilized and a method for manufacturing the accessories, such as rings, bracelets or earrings by penetrating a wire through a plurality of small gemstones and welding the wire to the small gemstones with laser, more particularly, to accessories for which small gemstones can be utilized and a method for manufacturing the same, which can firmly fix small gemstones, which are difficult to use due to the small size thereof and can minimize the deformation of the accessories due to heat by welding the wire to the accessories with laser.

BACKGROUND ART

Many people exert their personalities using accessories. Earrings, which have been the earliest, among the accessories used for adorning the people's bodies have been valued as amulets in many countries of the ancient Orient.

Recently, children and adults of all ages wear earrings of various colors in order to exert their personalities, and lots of people enjoy piercing to fix pins or accessories after piercing a part of the body besides the ears.

There are various earrings, such as button type earrings which are screw-coupled, mobile-shaped earrings, slave earrings of a big ring shape, and others.

Korean Utility Model Registration No. 20-0289734 (granted on Sep. 5, 2002) discloses an earring having a jewel fixing support, which can easily fix jewels or glass beads used for enhance an aesthetic sense of the earring, lower production costs by reducing consumption of raw materials in comparison with accessories of the same size since reducing weight due to a space formed in its metal frame, and enhance wearing sensation.

However, such a conventional art has a disadvantage in that manufacturing costs are increased since requiring the fixing support for fixing ornaments, such as jewels or glass beads, to the earring.

DISCLOSURE

Technical Problem

Accordingly, the present invention has been made in an effort to solve the above-mentioned problems occurring in the prior arts, and it is an object of the present invention to provide a technology to produce rings, bracelets or earrings by a simple method of stringing small gemstones, which are difficult to use due to the small size thereof, on a wire.

Technical Solution

To achieve the above objects, the present invention provides an accessory capable of utilizing small gemstones including: an accessory body (100) having a ring-shaped body (110) opened at one side, an insertion groove (120) formed along the outer circumferential surface, and fixing holes (130) formed on surfaces of both ends of the ring-shaped body (110); a plurality of small gemstones (200) located on the insertion groove (120) of the accessory body (100), each of the small gemstones (200) having a through hole (210) formed in the middle thereof; and a wire (300) passing through the through holes (210) of the small gemstones (200) and fixed to the fixing holes (130) by laser welding.

In this instance, a closing part (400) is welded to the open side of the ring-shaped body (110) with laser so that the accessory is usable as a ring or a bracelet, or an earring pin (P) is welded to one end portion of the wire (300) fixed to the fixing hole (130) of the ring-shaped body (110) with laser so that the accessory is usable as an earring.

In another aspect of the present invention, the present invention provides a method for manufacturing accessories capable of utilizing small gemstones comprising: a first step (S100) of manufacturing, by casting method, an accessory body (100) which has a ring-shaped body (110), an insertion groove (120) formed along the outer circumferential surface of the ring-shaped body (110) of which one side is open, and fixing holes (130) formed on surfaces of both ends of the ring-shaped body (110); and a second step (S200) of passing a wire (300) through through holes (210) of a plurality of small gemstones (200) and welding both end portions of the wire to the fixing holes (130) with laser in order to locate a plurality of the small gemstones (200), each of which has the through hole (210) formed in the middle, on the insertion groove (110) of the accessory body (100).

Additionally, the method for manufacturing accessories capable of utilizing small gemstones further comprising: a third step (S300) of welding a closing part (400) to the open ends of the ring-shaped body (110) with laser so that the accessory is usable as a ring or a bracelet, or welding an earring pin (P) to one end portion of the wire (300) fixed to the fixing hole (130) of the ring-shaped body (110) with laser so that the accessory is usable as an earring.

Advantageous Effects

The present invention can firmly fix small gemstones, which are difficult to use due to the small size thereof, to accessories (rings, bracelets, or earrings) by a simple method, and minimize deformation of the accessories due to heat by welding a wire to the accessories with laser, thereby reducing manufacturing cost and increasing completeness of products.

BEST MODE

Figure 1:
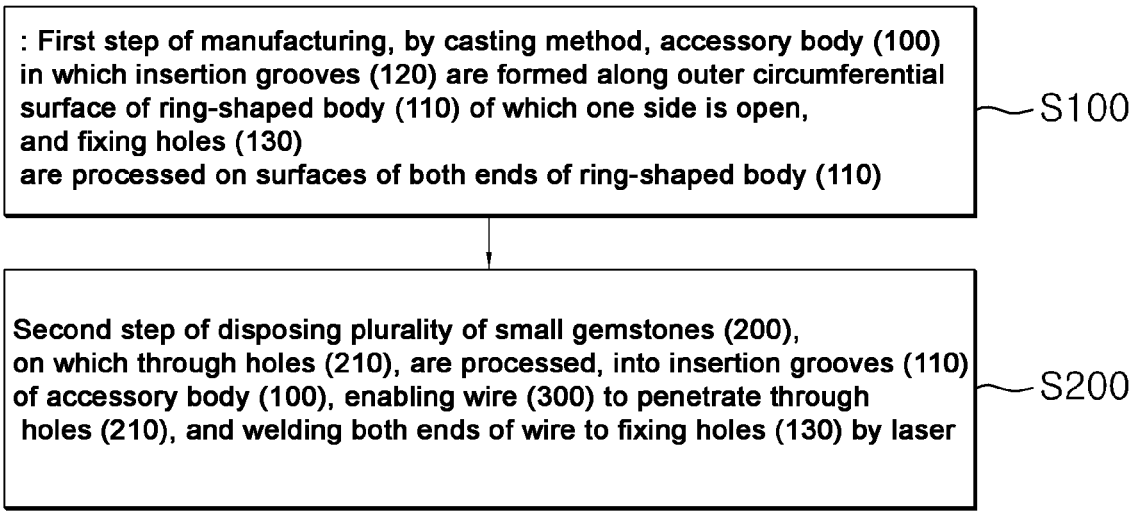
FIG. 1 is a flow chart of a method for manufacturing accessories by utilizing small gemstones.

An accessory capable of utilizing small gemstones according to the present invention includes: an accessory body 100 having a ring-shaped body 110 opened at one side, an insertion groove 120 formed along the outer circumferential surface, and fixing holes 130 formed on surfaces of both ends of the ring-shaped body 110; a plurality of small gemstones 200 located on the insertion groove 120 of the accessory body 100, the small gemstones 200 respectively having through holes 210 formed in the middle thereof; and a wire 300 passing through the through holes 210 of the small gemstones 200 and fixed to the fixing holes 130 by laser welding.

MODE FOR INVENTION

Figure 2:
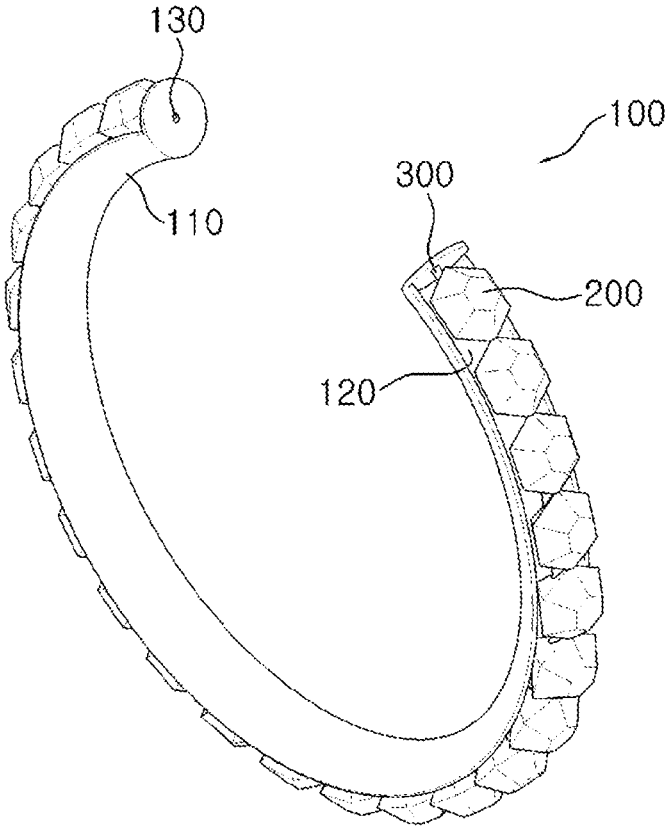
FIG. 2 is a perspective view showing the entire image of the accessory according to the present invention.
Figure 3:
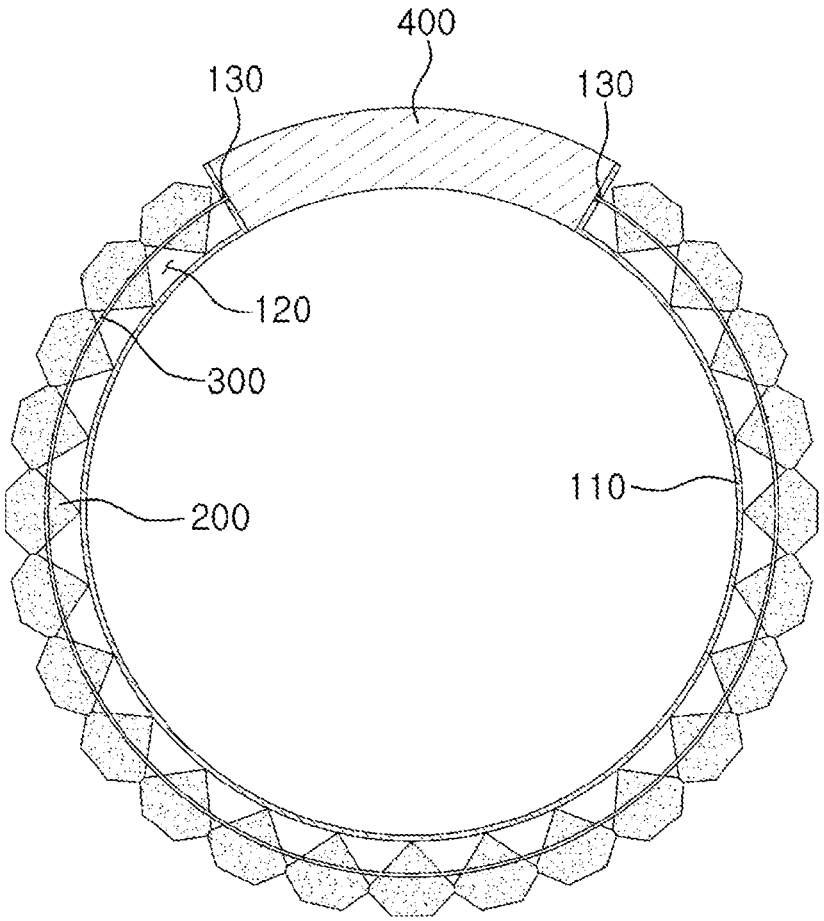
FIG. 3 is an exemplary view showing a state where a closing part is welded to the accessory with laser.
Figure 4:
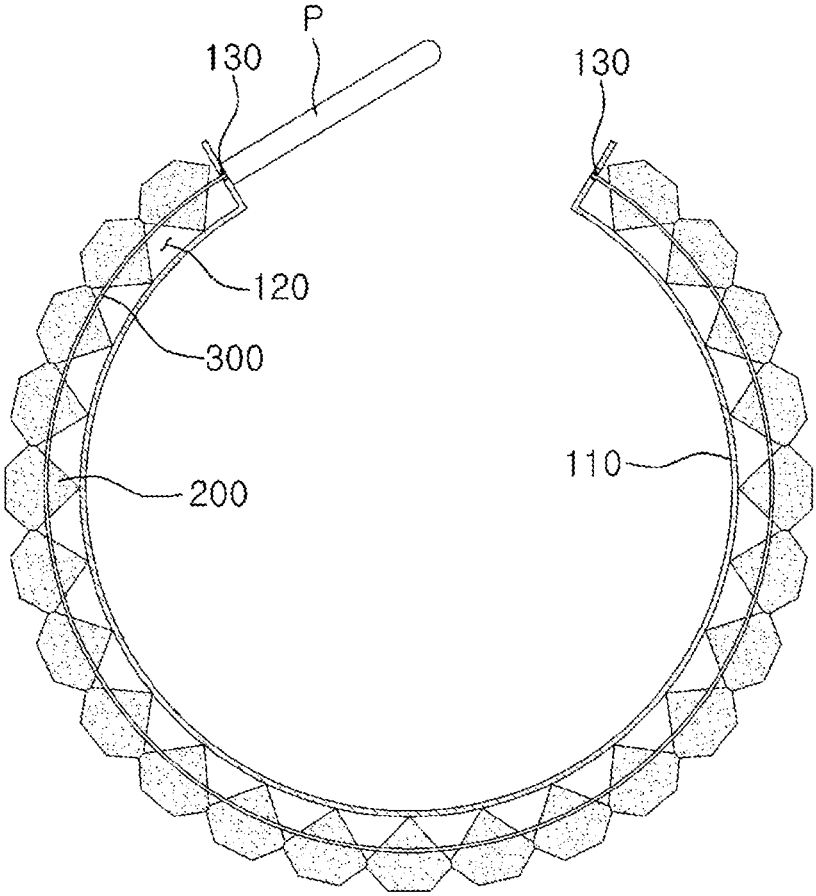
FIG. 4 is an exemplary view showing a state where an earring pin is welded to the accessory with laser.

As shown in FIGS. 1 to 4, an accessory capable of utilizing small gemstones according to the present invention includes: an accessory body 100, a plurality of small gemstones 200, a wire 300, and a closing part 400, and a method for manufacturing accessories by utilizing small gemstones includes a first step S100, a second step S200, and a third step S300.

The accessory body 100 includes a ring-shaped body 110 opened at one side, an insertion groove 120 formed along the outer circumferential surface, and fixing holes 130 formed on surfaces of both ends of the ring-shaped body 110.

So, the small gemstones 200 are located on the insertion groove 120 of the accessory body 100, and respectively have through holes 210 formed in the middle thereof.

The wire 300 passes through the through holes 210 of the small gemstones 200 and is welded to the fixing holes 130 with laser.

In other words, an end portion of the wire 300 is welded to the fixing hole 130 with laser, and an earring pin (P) is also welded near the fixing hole of the ring-shaped body 110 with laser.

In this instance, the closing part 400 is welded to the open side of the ring-shaped body 110 with laser so that the accessory can be used as a ring or a bracelet. Alternatively, the earring pin (P) is welded to one end portion of the wire 300 fixed to the fixing hole 130 of the ring-shaped body 110 with laser so that the accessory can be used as an earring.

The closing part 400 means a part to close the open side when goods of precious metals are manufactured.

Meanwhile, in the first step S100, the insertion groove 120 is formed along the outer circumferential surface of the ring-shaped body 110, which has the open side, by a casting method, and fixing holes 130 are formed on the surfaces of both ends of the ring-shaped body 110.

Moreover, in the second step S200, the wire 300 passes through the through holes 210 of the small gemstones 200 in order to dispose a plurality of small gemstones on the insertion groove 110 of the accessory body 100, and both end portions of the wire are welded to the fixing holes 130 with laser.

In the third step S300, the earring pin (P) is welded to an end portion of the wire 300 welded to the fixing holes 130 with laser.

In this instance, the earring pin (P) is fixed to the wire 300, and is also welded to the ring-shaped body 110 near the fixing hole 130 with laser.

In the third step S300, the closing part 400 is welded to the open ends of the ring-shaped body 110 with laser so that the accessory can be used as a ring or a bracelet, or the earring pin (P) is welded to one end portion of the wire 300 fixed to the fixing hole 130 of the ring-shaped body 110 with laser so that the accessory can be used as an earring.

That is, the present invention can firmly fix small gemstones, which are difficult to use due to the small size thereof, to accessories by a simple method, and minimize deformation of the accessories due to heat by welding a wire to the accessories with laser, thereby reducing manufacturing cost and increasing completeness of products.

Therefore, in case that the closing part 400 is welded to the accessory body 100 with laser, the accessory can be used as a ring or a bracelet according to the size of the accessory body.

While the present invention has been particularly shown and described with reference to exemplary embodiments thereof, it will be understood by those of ordinary skill in the art that various changes, modifications, and equivalents may be made therein without departing from the technical idea and scope of the present invention and such changes, modifications, and equivalents belong to the claims of the present invention.

INDUSTRIAL APPLICABILITY

As described above, the present invention can firmly fix small gemstones, which are difficult to use due to the small size thereof, to accessories (rings, bracelets, or earrings) by a simple method, and minimize deformation of the accessories due to heat by welding a wire to the accessories with laser, thereby reducing manufacturing cost and increasing completeness of products. Therefore, the present invention is industrially applicable.

The invention claimed is:

1. A method for manufacturing accessories, comprising:

an accessory body which has a ring-shaped body, a first end of the ring-shaped body, and a second end of the ring shaped body, the accessory body further including an insertion groove formed along an outer circumferential surface of the ring-shaped body of which one side is open, a first fixing hole formed on a surface of the first end of the ring-shaped body, and a second fixing hole formed on a surface of the second end of the ring-shaped body;

passing a wire through through holes of a plurality of gemstones and welding a first end of the wire to the first fixing hole and a second end of the wire to the second fixing hole with a laser in order to position the plurality of the gemstones on the insertion groove of the accessory body; and welding, with the laser, a closing part or an earring pin, to the ring shaped body, wherein the closing part has a first closing end and a second closing end, the first closing end has a surface and the second closing end has a surface, and wherein the first closing end of the closing part is welded by the laser to the first end of the ring shaped body and the second closing end of the closing part is welded by the laser to the second end of the ring shaped body so that the accessory is usable as a ring or a bracelet, or an earring pin is welded by the laser to one of a first end of the wire in the first fixing hole formed on the surface of the first end of the ring-shaped body and a second end of the wire in the second fixing hole formed on the surface of the second end of the ring-shaped body so that the accessory is usable as an earring.

* * * * *